US009734974B2

(12) United States Patent
Colombo et al.

(10) Patent No.: US 9,734,974 B2
(45) Date of Patent: Aug. 15, 2017

(54) LOW VOLTAGE CIRCUIT BREAKER WITH A CONTROL DEVICE FOR RE-CLOSING SAID LOW VOLTAGE CIRCUIT BREAKER

(75) Inventors: Franco Colombo, Malnate (IT); Paolo Antonello, Arluno (IT)

(73) Assignee: ABB S.p.A., Milan (IT)

( * ) Notice: Subject to any disclaimer, the term of this patent is extended or adjusted under 35 U.S.C. 154(b) by 85 days.

(21) Appl. No.: 14/235,237

(22) PCT Filed: Jul. 31, 2012

(86) PCT No.: PCT/EP2012/064956

§ 371 (c)(1),
(2), (4) Date: Jan. 27, 2014

(87) PCT Pub. No.: WO2013/017595

PCT Pub. Date: Feb. 7, 2013

(65) Prior Publication Data

US 2014/0166452 A1 Jun. 19, 2014

(30) Foreign Application Priority Data

Aug. 1, 2011 (IT) ..... BG2011A0034

(51) Int. Cl.
*H01H 71/66* (2006.01)
*H01H 3/22* (2006.01)
(Continued)

(52) U.S. Cl.
CPC ..... *H01H 71/66* (2013.01); *H01H 3/22* (2013.01); *H01H 37/323* (2013.01); *H01H 71/04* (2013.01);
(Continued)

(58) Field of Classification Search
CPC ..... H01H 3/22; H01H 61/0107; H01H 71/46; H01H 71/66; H01H 2071/665;
(Continued)

(56) References Cited

U.S. PATENT DOCUMENTS 4,551,975 A * 11/1985 Yamamoto ..... H01H 61/0107 60/528
4,829,843 A * 5/1989 Suzuki ..... F03G 7/065 337/140
(Continued)

FOREIGN PATENT DOCUMENTS

EP 1505620 A2 2/2005
IT EP 1870919 A1 * 12/2007 ..... H01H 71/70

*Primary Examiner* — Anatoly Vortman
*Assistant Examiner* — Jacob Crum
(74) *Attorney, Agent, or Firm* — Polsinelli PC

(57) ABSTRACT

The present invention refers to a low voltage circuit breaker with a control device for re-closing said low voltage circuit breaker. The control device is provided with an actuating element, comprising a shape memory material and operatively associated with maneuvering means for the circuit breaker. When this shape memory material performs a state transition, the actuating element causes the movement of said maneuvering means from a first operative position, associated with an open configuration of the circuit breaker, to a second operative position, associated with a closed configuration of the circuit breaker.

11 Claims, 6 Drawing Sheets

Figure 1:
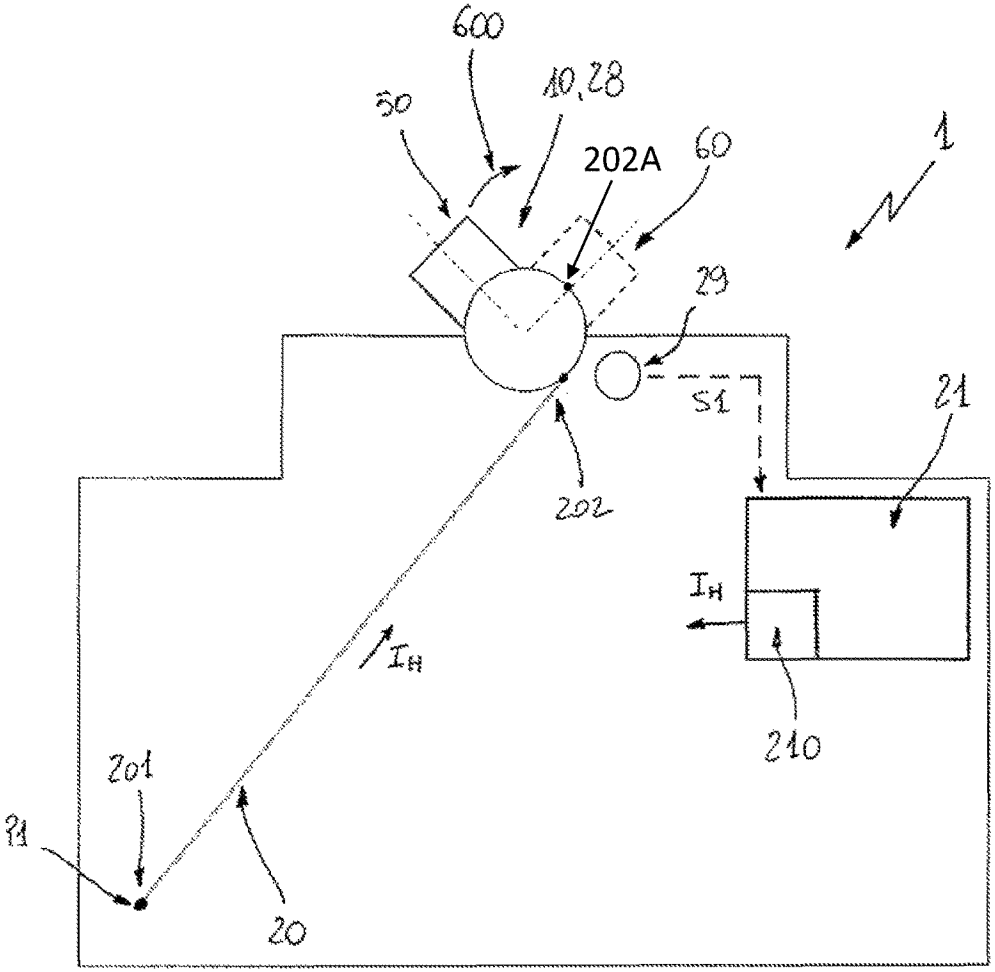

(51) Int. Cl.
*H01H 37/32* (2006.01)
*H01H 71/14* (2006.01)
*H01H 71/04* (2006.01)

(52) U.S. Cl.
CPC ..... *H01H 71/145* (2013.01); *H01H 2071/046* (2013.01); *H01H 2071/665* (2013.01)

(58) Field of Classification Search
CPC .... H01H 37/323; H01H 71/04; H01H 71/145; H01H 2061/0115–2061/0122; H01H 2071/046
USPC ..... 337/14, 123, 138–140, 382, 385
See application file for complete search history.

(56) References Cited

U.S. PATENT DOCUMENTS

| | | | | |
|---|---|---|---|---|
| 5,142,257 | A * | 8/1992 | Gamet | H01H 71/66 335/29 |
| 5,570,262 | A | 10/1996 | Doerwald | |
| 6,239,686 | B1 * | 5/2001 | Eder | H01H 37/323 337/123 |
| 6,714,106 | B1 * | 3/2004 | Czarnecki | H01H 3/22 200/331 |
| 6,851,260 | B2 * | 2/2005 | Mernoe | A61M 5/142 310/306 |
| 2005/0161312 | A1 * | 7/2005 | Agronin | H01H 3/227 200/330 |
| 2005/0195064 | A1 * | 9/2005 | Biasiotto | F03G 7/065 337/140 |
| 2009/0108779 | A1 * | 4/2009 | Takahashi | F03G 7/065 318/117 |
| 2012/0125750 | A1 * | 5/2012 | Mayer | H01H 71/04 200/335 |

* cited by examiner

LOW VOLTAGE CIRCUIT BREAKER WITH A CONTROL DEVICE FOR RE-CLOSING SAID LOW VOLTAGE CIRCUIT BREAKER

CROSS REFERENCE TO RELATED APPLICATIONS

This application is a National Phase filing under 35 U.S.C. §371 of PCT/EP2012/064956 filed on Jul. 31, 2013; and this application claims priority to Application No. BG2011A000034 filed in Italy on Aug. 1, 2011, under 35 U.S.C. §119; the entire contents of all are hereby incorporated by reference.

BACKGROUND OF THE INVENTION

Field of the Invention

The present invention relates to the field of circuit breakers for low voltage electric lines (i.e. with a voltage of less than 1 KV) of a single-phase or three-phase type.

In particular, the invention refers to a low voltage circuit breaker with a control device for re-closing said low voltage circuit breaker, for example a residual current circuit breaker or a miniature circuit breaker.

Description of Related Art

As is known, a low voltage circuit breaker is a device that can assume two distinct operating configurations.

In the closed configuration, the electrical contacts of the circuit breaker are coupled so as to enable the passage of current along the electric line the circuit breaker is operatively associated with.

In the open configuration, the electrical contacts are separated and the passage of current along the electric line is interrupted.

The switching of the circuit breaker from the closed configuration to the open configuration (opening manoeuvre) can be done manually, by turning a circuit breaker operating lever. Alternatively, the opening manoeuvre can be carried out automatically by an uncoupling relay separates the electrical contacts following receipt of a command signal or when particular operating conditions in the electric line are detected, such as the presence of an earth leakage current, for example.

In certain types of circuit breakers, the switching of the circuit breaker from the open configuration to the closed configuration (closing manoeuvre) can only be done manually, by turning the circuit breaker lever in the direction opposite that used for the opening manoeuvre.

Other types of circuit breakers have automatic re-closure of the contacts, when this is permitted by the operating conditions of the electric line.

In this case, the circuit breaker closing manoeuvre is performed automatically, thanks to the action of a control device, operatively associated with the circuit breaker manoeuvring lever. There are also types of circuit breaker that feature the remote re-closure of the contacts, thanks to a rearming lever operatively associated with the circuit breaker manoeuvring lever. This rearming lever may be in turn operatively associated with a control device, in a remote position with respect to the body of the circuit breaker.

Patent applications EP1505620 and EP1870919 describe several known examples of control devices for re-closing low voltage circuit breakers.

These devices comprise a servo-mechanism adapted to pilot a rearming lever, in turn operatively associated with the circuit breaker, between two predetermined positions, each of which is associated with an operative configuration of the circuit breaker.

Currently available control devices for re-closing circuit breakers present certain disadvantages, mainly associated with a relatively complex, bulky structure that is relatively expensive to produce industrially.

Installation of current control devices is often laborious, particularly when the space available for installation is relatively limited, such as in small electrical cabinets.

BRIEF SUMMARY OF THE INVENTION

A main task of the present invention is therefore to provide a low voltage circuit breaker with a control device for re-closing said low voltage circuit breaker, that can overcome the aforementioned problems.

In the context of this task, a further aim of the present invention is to provide a low voltage circuit breaker with a control device with notable installation flexibility, even in small electrical cabinets.

A further aim of the present invention is to provide a low voltage circuit breaker with a control device with a relatively simple overall structure that is easy and economical to produce industrially.

This task and these aims, along with other aims that will become apparent from the following description and attached drawings, are achieved, according to the invention, by a low voltage circuit breaker with a control device for re-closing said low voltage circuit breaker.

The low voltage circuit breaker with control device, according to the invention, is characterised in that it is provided with at least one actuating element, comprising a shape memory material.

This actuating element is operatively associated with circuit breaker manoeuvring means. When the shape memory material performs a state transition, i.e. when it passes from the martensite state to the austenite state, or vice-versa, the actuating element causes the movement of said manoeuvring means from a first operative position, associated with an open configuration of the circuit breaker, to a second operative position, associated with a closed configuration of the circuit breaker.

According to an embodiment of the present invention, the control device actuating element causes the movement of said manoeuvring means when said shape memory material passes from the martensite state to the austenite state, particularly when the shape memory material is heated to a temperature higher than its own state transition temperature.

According to an alternative embodiment of the present invention, the control device actuating element causes the movement of said manoeuvring means when said shape memory material passes from the austenite state to the martensite state, particularly when the shape memory material is cooled to a temperature that is lower than its own state transition temperature. According to an embodiment of the present invention, the control device actuating element comprises a cable made of a shape memory material.

Alternative embodiments may have a control device actuating element comprising a spring or a lamina made of a shape memory material.

Preferably, the control device manoeuvring means perform a rotary movement around a pre-defined axis in order to pass from said first operative position to said second operative position.

Preferably, in the circuit breaker according to the invention, the control device comprises an electric power source configured provide an electric current to heat said shape memory material to a pre-defined temperature.

Furthermore, preferably, in the circuit breaker according to the invention, the control device comprises a control unit, configured to control the activation of said actuating element, and sensing means configured to generate a position signal indicative of the operative position of the manoeuvring means.

The use of an actuating element comprising shape memory material enables the structure of the control device to be drastically simplified.

The control device used in the circuit breaker according to the invention, presents considerable flexibility of use and installation, and is easy and economical to produce industrially.

BRIEF DESCRIPTION OF SEVERAL VIEW OF THE DRAWINGS

Figure 3:
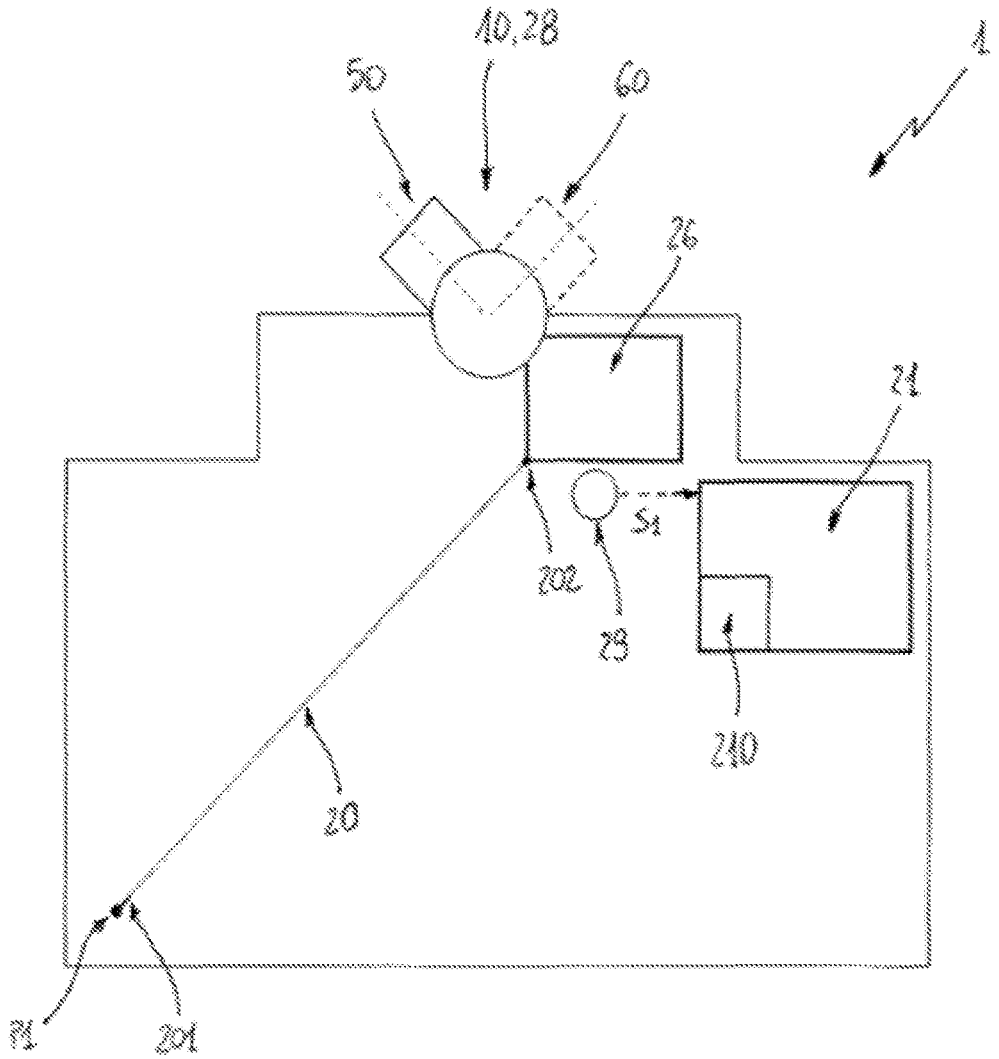
Figure 4:
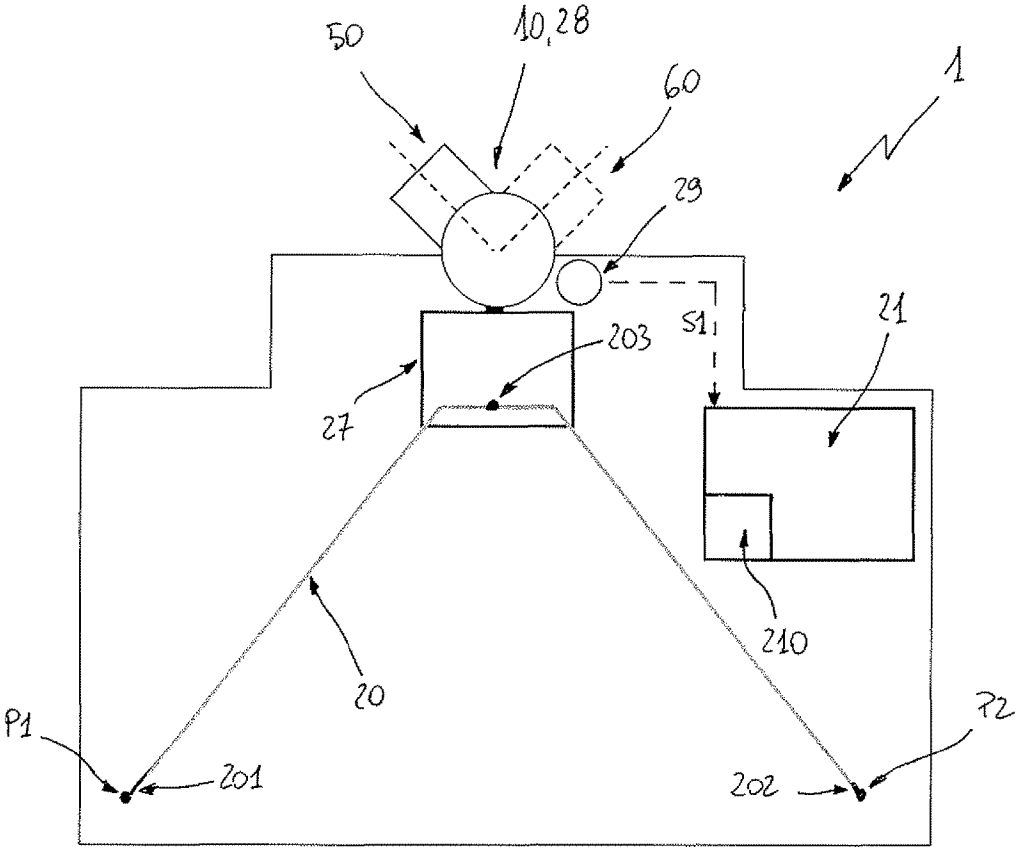
Figure 5:
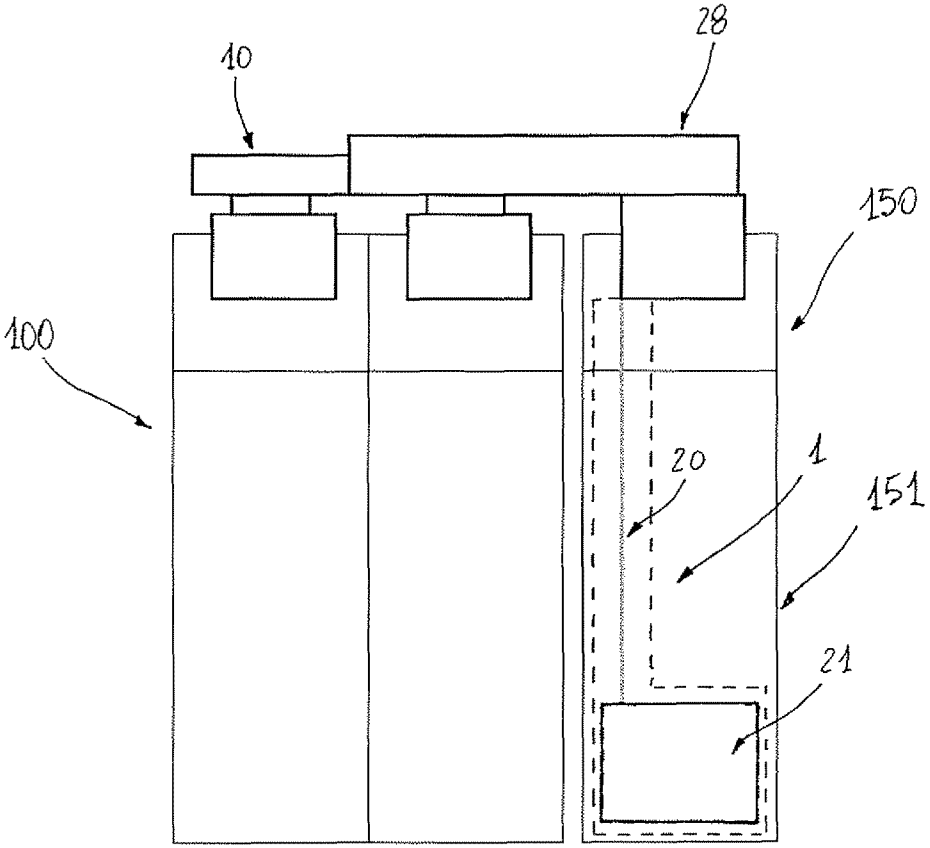
Figure 6:
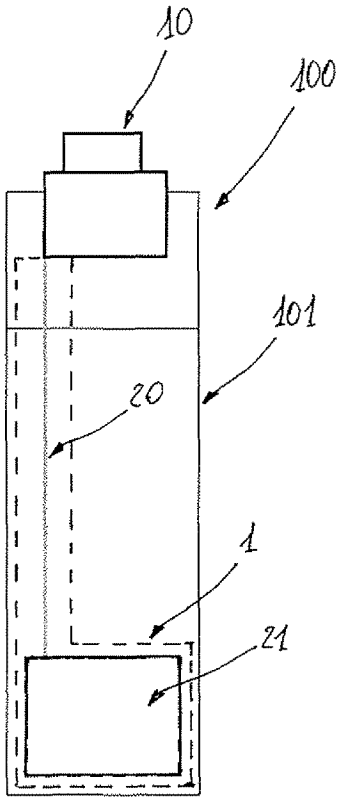

Further features and advantages of the invention will become more apparent from the following description and illustrated in the accompanying drawings, provided by way of non-limitative example, in which:

FIGS. 1-4 show a schematic illustration of the structure of the control device, according to the present invention, in several preferred embodiments thereof; and FIGS. 5-6 show several examples of operational use of the control device, according to the present invention.

DETAILED DESCRIPTION OF THE INVENTION

With reference to the figures mentioned, the present invention refers to a control device 1 for re-closing a low voltage circuit breaker 100.

The circuit breaker 100 may be any type of low voltage circuit breaker, for example a Residual Current Circuit Breaker (RCCB), a Miniature Circuit Breaker (MCB), a Molded Case Circuit Breaker (MCCB), a Residual Current Circuit Breaker with overcurrent protection (RCBO), a power circuit breaker, a control circuit breaker, a disconnecting switch or similar.

The control device 1 is operatively associated with manoeuvring means 10, 28 for the circuit breaker 100.

These manoeuvring means can assume a first operative position 50 and a second operative position 60, respectively associates with an open and closed circuit breaker 100 configuration. According to the invention, the control device 1 comprises at least one actuating element 20, comprising a shape memory material.

The term "shape memory material" refers to a material, for example a metallic material, that can assume a pre-set macroscopic shape as soon as the temperature of the said material exceeds a pre-defined threshold value (state transition temperature).

As temperature varies, a shape memory material is therefore able to perform reversible transitions of its physical state, at which points the mechanical properties of the material change significantly.

At a temperature below the state transition temperature, a shape memory material is in a martensite state, in which it is easily mechanically deformable, depending on one's needs. When the temperature exceeds the state transition temperature, the shape memory material passes to the austenite state, in which it immediately recovers its original form, developing relatively high forces during this transition.

Examples of shape memory material that can be used to make the actuating element 20 are metal alloys such as Nickel-Titanium, Copper-Aluminum-Nickel, Copper-Zinc-Aluminium and Ferro-Manganese-Silicon.

According to the invention, the actuating element 20 is operatively associated with the manoeuvring means 10, 28 for the circuit breaker 100 so that, when the shape memory material performs a state transition, i.e. when it passes from the martensite state to the austenite state, or vice-versa, the actuating element 20 can cause the movement of the manoeuvring means 10, 28 from the first operative position 50 to the second operative position 60.

In the case in which the control device 1 is placed in an autonomous control module 150 for closing the circuit breaker 100, the circuit breaker manoeuvring means preferably comprise the manoeuvring lever 10 and a rearming lever 28, operatively associated with the manoeuvring lever 10.

The levers 10 and 28 are advantageously integrally connected to one another and perform a rotary movement, with a pre-defined direction and amplitude, around an axis of rotation, in order to move between the operating positions 50 and 60.

Advantageously, the actuating element 20 can be operatively connected to the rearming lever 28.

In the case in which the control device 1 is integrated into the body of the circuit breaker 100 (FIG. 6), said manoeuvring means advantageously comprise only the circuit breaker manoeuvring lever 10.

In this case, advantageously, the actuating element 20 can be operatively connected directly to the manoeuvring lever 10, which is advantageously able to move between the pre-defined positions 50, 60 with a rotary movement, with a pre-defined direction and amplitude, around an axis of rotation.

Preferably, the actuating element 20 comprises at least one cable made of a shape memory material, for example Nickel-Titanium alloy with a state transition temperature of around 90° C.

The actuating element 20 may comprise a single cable 20 made of a shape memory material or a plurality of cables twisted so as to have ends that are coupled or otherwise operatively associated with one another.

A plurality of coils may be advantageously provided for each cable so as to reach a sufficient length to develop adequate force during a state transition.

Alternative forms of the present invention see the actuating element comprising at least one lamina or spring made of shape memory materials.

According to one embodiment of the present invention (FIG. 1-3), the actuating element 20 comprises a first end 201, attached to an anchor point $P_1$, and a second end 202, operatively associated with the manoeuvring means 10, 28 for the circuit breaker 100.

Figure 2:
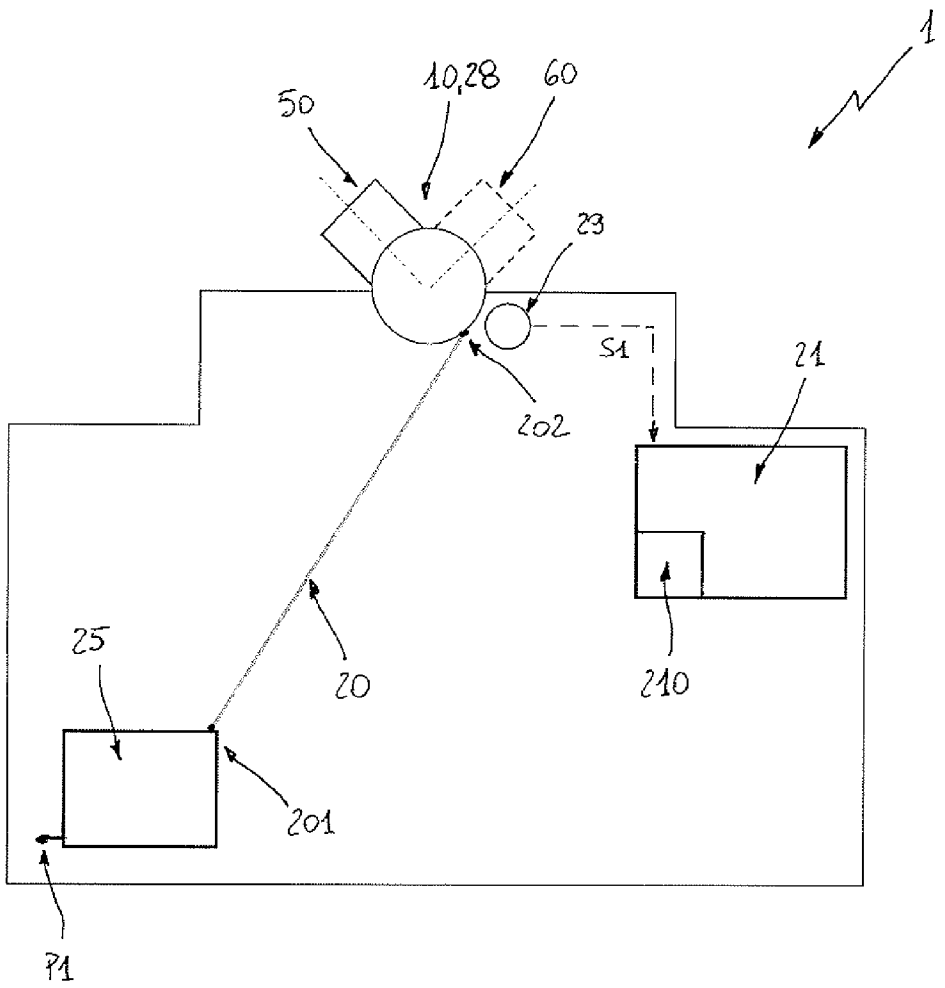

According to the embodiment shown in FIG. 2, a first kinematic chain 25 is provided to operatively connect the end 201 of the actuating element 20 to the anchor point $P_1$.

According to the embodiment shown in FIG. 3, a second kinematic chain 26 is provided to operatively connect the end 202 of the actuating element 20 to the manoeuvring means 10, 28. Further variants of the embodiment just described may have kinematic chains arranged to correspond to both ends of the actuating element 20.

According to another embodiment of the present invention (FIG. 4), the actuating element 20 comprises a first end 201, attached to a first anchor point $P_1$, and a second end 202, attached to a second anchor point $P_2$.

In this case, the actuating element 20 is operatively associated with the manoeuvring means 10, 28 in at least one attachment point 203, in an intermediate position between the ends 201 and 202.

According to the embodiment shown in FIG. 4, a third kinematic chain 27 is provided to operatively connect the attachment point 203 of the actuating element 20 to the manoeuvring means 10, 28.

Other embodiments may have kinematic chains arranged to correspond to one or both ends 201 and 202 of the actuating element 20 for operative connection with the anchor points $P_1$ and $P_2$.

The use of the kinematic chains 25-27 is advantageous because it makes it possible to correctly regulate the interaction of the actuating element 20 with the manoeuvring means 10, 28, during circuit breaker manoeuvres.

Furthermore, the kinematic chains 25-27 enable regulation, according to one's needs, of the travel of the manoeuvring means 10, 28, during circuit breaker manoeuvres.

In the case in which the control device 1 is placed in an autonomous control module 150, to re-close the circuit breaker 100, the anchor points $P_1$ and $P_2$ are advantageously made in a position corresponding to the casing 151 of the control module 150.

In the case in which the control device 1 is integrated into the body of the circuit breaker 100, the points $P_1$ and $P_2$ are advantageously made in a position corresponding to the casing 101 of the circuit breaker itself.

Preferably, the actuating element 20 is operatively associated with thermal dissipation means (not shown) configured to help cool the shape memory material.

For example, the actuating element 20 may be encapsulated in a sealed casing containing a thermally conductive paste in contact with the shape memory material, capable of dissipating the heat accumulated by the shape memory material in the austenite state, thereby favouring the transition to the martensite state.

Preferably, the control device 1 comprises an electric power source 210 configured to provide an electric current $I_H$ to heat the shape memory material to a pre-defined temperature.

The electric power source 210 may advantageously comprise an electronic power stage capable of deriving the current $I_H$ from the electric line with which the circuit breaker 100 is operatively associated, or from a separate power supply device, such as a switching power supply, for example.

Preferably, the control device 1 comprises a control unit 21 configured to control the activation of the actuating element 20, particularly the sending of current $I_H$ from the electric power source 210.

Preferably, the control device 1 comprises sensing means 29 configured to generate a position signal $S_1$, indicating the position of the manoeuvring means 10, 28.

Advantageously, the position signal S1 is sent as an input to the control unit 21.

The control unit 21, once it receives information about the actual position of the manoeuvring means 10, 28, is able to send a control signal to the electric power source 201, so that the power source can generate or interrupt, depending on one's needs, the electric current $I_H$ needed to heat the shape memory material of the actuating element 20 to a temperature that is higher than the state transition temperature.

According to one embodiment of the present invention, the actuating element 20 causes the movement of the manoeuvring means 10, 28 when the shape memory material passes from the martensite state to the austenite state, that is when the shape memory material is heated to a temperature higher than its own state transition temperature.

In this case, the actuating element 20 is advantageously operatively associated with the manoeuvring means 10, 28 in order to develop, during the aforementioned state transition, adequate force to move the aforementioned manoeuvring means from the operative position 50 to operative position 60.

The operation of the control device 1, in this embodiment, will now be described in greater detail (FIG. 1), with specific but non-limiting reference to the case in which the actuating element 20 consists of a single cable made of a shape memory material.

The cable 20 is produced industrially with a pre-defined length and cross-section.

The length of the cable 20 can be advantageously sized according to the intensity of the force that needs to be exerted to move the manoeuvring means 10, 28. To be of sufficient length, without excessively increasing the size of the control device 1, the cable 20 may be wound in a series of coils.

The cross-section of the cable 20 can advantageously be sized according to the re-closure time needed for a low voltage circuit breaker (around 1 sec), which in turn depends on the maximum possible intensity for the current $I_H$.

The cable 20 is mounted operatively so that, when at rest, with the circuit breaker 20 in the closed configuration, it is in the martensite state and is the same length as its original length. Cable 20 extends from 201 to 202 as shown by the solid line of cable 20 in FIG. 1, and has a corresponding rest length.

An opening manoeuvre performer on the circuit breaker, for example due to a protection trip, causes the manoeuvring means 10, 28 to move from the operative position 60 to operative position 50.

During this opening manoeuvre, the cable 20, since it is attached to the manoeuvring means 10, 28, is subjected to a force exerted by the user or by organs (not shown) performing the opening manoeuvre on the circuit breaker.

When in the martensite state, the cable 20 undergoes a mechanical deformation, particularly an elongation substantially proportional to the angular distance covered by the rotation of the manoeuvring means 10, 28, during the opening manoeuvre. In the embodiment of FIG. 1, the end 202 of cable 20 will rotate to point 202A; the stretched length of cable 20 is shown by a combination of the solid line pathway in FIG. 1 from 201 to 202 plus the rotational distance on the outer edge of manoeuvring means 28 from 202 to 202A.

Once the opening manoeuvre is completed, the sensing means 29 send the control unit 21 a position signal S1, indicating the new operative position taken up by the manoeuvring means 10, 28.

When the operative conditions exist to re-close the circuit breaker, for example in the absence of faults or dispersion currents, the control unit 21 generates a closing command signal for the electric power source 201.

The latter, upon receipt of the input command, generates an electric current $I_H$ to activate the cable 20, heating the memory material to a temperature that is higher than its state transition temperature.

The shape memory material of the cable 20 passes from the martensite state to the austenite state.

During this state transition, the cable 20 returns to its original form, shortening until it reaches its original length.

As a result of this shortening, the cable exerts a force whose intensity and direction is such that it can return the manoeuvring means 10, 28 to the operative position 60 (arrow 600). Once the closing manoeuvre is completed, the sensing means 29 send the control unit 21 a position signal S1, indicating the new operative position taken up by the manoeuvring means 10, 28.

The control unit 21 sends a new command signal to the electric power source 210 to interrupt generation of the electric current $I_H$.

The shape memory material of the cable 20 is left to cool for the time needed to return to the martensite state.

The action of the thermally conductive paste in contact with the shape memory material favours this state transition, reducing the waiting time (several seconds) before a possible re-activation of the cable 20.

Once it has returned to the martensite state, the actuating element 20 can once again be activated to re-close the circuit breaker automatically, following an opening manoeuvre. According to an alternative embodiment of the present invention, the actuating element 20 causes the movement of the manoeuvring means 10, 28 when the shape memory material passes from the austenite state to the martensite state, i.e. when the shape memory material is cooled to a temperature that is lower than its own state transition temperature.

In this case, the actuating element 20 is advantageously operatively associated with the manoeuvring means 10, 28 so as to allow, during this state transition, the movement of the aforementioned manoeuvring means from the operative position 50 to operative position 60. Preferably, the actuating element 20 is advantageously operatively associated with the manoeuvring means 10, 28 so as to contrast the action of a further antagonist actuating element (not shown), arranged so as to cause the movement of the manoeuvring means 10, 28 from the operative position 50 to operative position 60, causing the re-closure of the circuit breaker.

This embodiment (not shown) of the control device 1 will also be described below in greater detail, with specific but non-limiting reference to the case in which the actuating element 20 consists of a single cable made of a shape memory material, The cable 20 is mounted operatively so that, when at rest, with the circuit breaker in the closed configuration, it is in the martensite state and is mechanically deformed so as to have a length greater than its original length.

When the circuit breaker has completed an opening manoeuvre, the sensing means 29 send the control unit 21 a position signal S1, indicating the new operative position taken up by the manoeuvring means 10, 28.

The control unit 21 generates an opening command signal for the electric power source 201. The latter, upon receipt of the input command, generates an electric current $I_H$ to activate the cable 20, heating the memory material to a temperature that is higher than its state transition temperature.

The shape memory material of the cable 20 passes from the martensite state to the austenite state, recovers its original length and exerts a force that opposes the action of a further antagonist actuating element, for example a spring, which is in turn operatively associated with the manoeuvring lever or with the rearming lever of the circuit breaker, so as to cause the re-closure of the circuit breaker.

Note how, in this embodiment, after the opening manoeuvre of the circuit breaker, the cable 20 is kept active, i.e. in the austenite state, by the continuous flow of electrical current $I_H$ that heats and maintains the shape memory material at a temperature that is higher than its state transition temperature.

When it is in the austenite state, the cable 20 can block the re-closure of the circuit breaker, thanks to the action of the antagonist actuating element, whenever this is required by the operative conditions of the electric line with which the circuit breaker is operatively associated.

When the operative conditions exist to re-close the circuit breaker, for example in the absence of faults or dispersion currents, the control unit 21 generates a closing command signal for the electric power source 201.

The latter, upon receipt of the input command, interrupts generation of the electric current $I_H$. The shape memory material thereby cools to a temperature that is less than its state transition temperature and passes from the austenite state to the martensite state.

In the martensite state, the cable 20 is no longer able to oppose the action of the antagonist actuating element, thereby causing the re-closure of the circuit breaker.

During this closing manoeuvre, the cable 20, being in the martensite state, undergoes a mechanical deformation and is elongated.

The cable 20, which is mechanically deformed so as to have a length greater than its original length, remains in the martensite state until there is a new opening manoeuvre of the circuit breaker.

It has been seen in practice that the control device 1, according to the present invention, performs the set task and achieves its aims.

The control device 1 features considerable flexibility of use.

It can be placed on a support card and be integrated into the body of the circuit breaker, with considerable benefits in terms of a reduction in size and in the spaces needed for installation of the re-closing circuit breaker.

On the other hand, the control device 1 can also be installed separately with respect to the body of the circuit breaker, in a specific control module, and operatively associable with the circuit breaker.

The control device 1 can be easily adapted to control the re-closure of single-phase or three-phase circuit breakers, as required.

For example, in the case in which it has to control a three-phase circuit breaker, three actuation devices 20 can be provided, operatively connected to three corresponding manoeuvring units, and able to be activated simultaneously by the control unit 21.

The control device 1 has a very simple structure, which can be easily produced industrially, at very low costs with respect to known devices.

The invention claimed is:

1. A low voltage circuit breaker comprising:

a control device for re-closing said low voltage circuit breaker, said control device being operatively associated with a manoeuvring means of said circuit breaker;

the manoeuvring means being transitionable between a first operative position, associated with an opening configuration of said circuit breaker, and a second operative position, associated with an closing configuration of said circuit breaker;

an actuating element comprising a shape memory material transitionable between a martensite state having a relaxed length and an austenite state having a fully contracted length, and operatively associated with said manoeuvring means;

the control device controlling the actuating element;

wherein when the manoeuvring means is in the second operative position, the circuit breaker is conducting electricity, the control device maintains the shape memory material in the martensite state, and the shape memory material is at the relaxed length;

wherein in response to the circuit breaker tripping the manoeuvring means moves from the second operative position to the first operative position, and the shape memory material in the martensite state stretches to a stretched length longer than the relaxed length;

wherein the control device resets the circuit breaker after the trip by changing the shape memory material from the martensite state to the austenite state, which contracts the shape memory material from the stretched length to the fully contracted length to move the manoeuvring means from the first operative position to the second operative position;

wherein, in response to the manoeuvring means moving from the first operative position to the second operative position during the reset, the control device transitions the shape memory material from the austenite state to the martensite state.

2. A low voltage circuit breaker, according to claim 1, wherein said actuating element causes the movement of said manoeuvring means, when said shape memory material is heated at a temperature that is higher than its own state transition temperature.

3. A low voltage circuit breaker, according to claim 1, wherein said actuating element comprises at least a cable, a lamina or a spring made of a shape memory material.

4. A low voltage circuit breaker, according to claim 1, wherein said control device controls a power source providing an electric current to heat ($I_H$) said shape memory material.

5. A low voltage circuit breaker, according to claim 1, wherein said manoeuvring means comprise a manoeuvring lever, said actuating element being operatively connected with said manoeuvring lever.

6. A low voltage circuit breaker, according to claim 1, wherein said manoeuvring means comprise a manoeuvring lever, operatively connected with a rearming lever, said actuating element being operatively connected with said rearming lever.

7. A low voltage circuit breaker, according to claim 1, wherein said control device is placed in an autonomous control module.

8. A low voltage circuit breaker, according to claim 2, wherein said actuating element comprises at least a cable, a lamina or a spring made of a shape memory material.

9. A low voltage circuit breaker, according claim 2, wherein said control device controls a power source providing an electric current to heat ($I_H$) said shape memory material.

10. A low voltage circuit breaker, according claim 3, wherein said control device controls a power source providing an electric current to heat ($I_H$) said shape memory material.

11. The circuit breaker of claim 1, wherein the relaxed length is the same as the fully contracted length.

* * * * *